US006804901B2

(12) United States Patent
Joubert et al.

(10) Patent No.: US 6,804,901 B2
(45) **Date of Patent: *Oct. 19, 2004**

(54) FOOTWEAR

(76) Inventors: Michel Joubert, 143 rue St-François-Xavier, Trois-Rivières, Quebec (CA), G9A 1P6; Patrice Roy, 91 rue Peel, Suite 300, Sherbrooke, Quebec (CA), J1H 4J9

( * ) Notice: Subject to any disclaimer, the term of this patent is extended or adjusted under 35 U.S.C. 154(b) by 0 days.

This patent is subject to a terminal disclaimer.

(21) Appl. No.: 10/223,727

(22) Filed: Aug. 20, 2002

(65) Prior Publication Data

US 2003/0093923 A1 May 22, 2003

Related U.S. Application Data

(62) Division of application No. 09/528,171, filed on Mar. 17, 2000, now Pat. No. 6,442,875, which is a continuation of application No. PCT/CA98/00872, filed on Sep. 18, 1998.

(30) Foreign Application Priority Data

Sep. 18, 1997 (CA) ..... 2215771
Jun. 5, 1998 (CA) ..... 2239738

(51) Int. Cl.[7] ..... A43C 11/00

(52) U.S. Cl. ..... 36/50.1; 36/54; 36/89; 36/93; 36/71; 36/115

(58) Field of Search ..... 36/89, 93, 71, 36/117.6, 115, 92, 94, 95, 50.1, 50.5, 54

(56) References Cited

U.S. PATENT DOCUMENTS

D83,790 S * 3/1931 Brown ..... D2/945
2,423,622 A * 7/1947 Samblanet
3,758,964 A * 9/1973 Nishimura
3,858,337 A * 1/1975 Vogel
4,373,275 A * 2/1983 Lydiard ..... 36/129
4,517,753 A * 5/1985 Rosenbaum et al. ..... 36/128
4,534,122 A 8/1985 MacPhail
4,616,432 A * 10/1986 Bunch et al. ..... 36/50.1
4,835,885 A * 6/1989 Hoshizaki et al. ..... 36/115
4,862,605 A * 9/1989 Gardner
4,955,148 A * 9/1990 Padilla
5,203,793 A * 4/1993 Lyden
5,404,659 A * 4/1995 Burke et al.
5,533,279 A * 7/1996 Mitsui et al. ..... 36/50.1
5,611,153 A * 3/1997 Fisher et al.
5,787,608 A * 8/1998 Greenawalt
6,014,823 A * 1/2000 Lakic
6,212,796 B1 * 4/2001 Kubelka ..... 36/50.1

FOREIGN PATENT DOCUMENTS

CH 626793 12/1981
FR 1406610 A * 6/1965
WO WO 94/07386 4/1994

* cited by examiner

*Primary Examiner*—Ted Kavanaugh
(74) *Attorney, Agent, or Firm*—Ogilvy Renault

(57) ABSTRACT

A skate boot having a sole and an upper, the upper having a medial quarter and a lateral quarter and defining a first pair of parallel fastening rows around the front edge of each quarter, at least in the vamp area of the boot. The median axis of the rows extends between the third and the fourth metatarsal bones of the foot.

8 Claims, 5 Drawing Sheets

FOOTWEAR

CROSS-REFERENCE TO RELATED APPLICATION

This application is a divisional application of U.S. application Ser. No. 09/528,171 filed Mar. 17, 2000 now U.S. Pat. 6,442,875 which is a continuation of PCT/CA98/00872 filed on Sep. 18, 1998.

BACKGROUND OF THE INVENTION

1. Field of the Invention

The present invention relates to a footwear, and particularly to a boot to be used with a runner such as a boot for an ice, inline, or roller skate, cross country ski, snowboard, etc.

2. Description of the Prior Art

The developments of skate boots in the last twenty years have been in the direction of a more rigid boot partly because of the advent of molded plastic shells for the construction of skate boots. Such techniques have allowed a more rigid construction of the uppers, presumably to increase performance, and to improve the protection of the skater. However, there is little consideration for the anatomy or the biomechanics of the foot. The foot is a very complex biomechanical structure with scores of articulates bones, cartilage and muscles. When the foot is encased in a conventional molded plastic shell, little of the mechanical advantages of the complex leverage movements can be transferred to the runner, i.e. blade inline rollers or cross country ski, because of the rigidity of the shell and the instability of the foot within the slipper.

The rigid shell forming the upper, in conventional molded skate boots, is uncomfortable. Various soft inner boots or slippers have been designed for use with such rigid boots to be adapted and to be formed to the foot of the wearer. However, the skate is not therefore responsive to the thrust of the foot. Some of the force being transferred to the foot laterally, or torquewise, is loss due to the movement of the slipper relative to the shell.

SUMMARY OF THE INVENTION

It is an aim of the present invention to provide a boot which is comfortable while providing stability for the foot, thereby providing a high degree of performance.

It is a further aim of the present invention to provide a boot which is designed respecting anatomy and biomechanical aspects of the foot.

It is a further aim of the present invention to provide a boot which has a relatively rigid upper and provided with selected flexible portions to allow suitable flexion extension about the ankle.

It is a further aim of the present invention to provide a boot upper having a lateral quarter and a medial quarter which are asymmetric and mostly rigid.

It is a further aim of the present invention to provide a pair of flexible compressible wall portions provided in the lateral and medial quarters but aligned in a plane containing the general flexion and extension movements of the foot in relation to the ankle.

It is a further aim of the present invention to provide a pair of fastening rows and tongue which extend in the lower part over the vamp, on either side of an axis extending parallel to and between the third and fourth metatarsal bones. The upper part of the lacing is provided on either side of an axis which is aligned with the upper anterior portion of the ankle and which is offset from the axis of the lacing in the lower part thereof.

It is a further aim of the present invention to provide a tongue which extends from the toe box in the area of the vamp and which is coincident with the lacing on the lower part of the upper and which extends offset to be oriented with the lacing in the upper part of the upper.

It is yet a further aim of the present invention to provide an improved inner sole or foot bed in the boot.

It is an aim of the present invention to provide a boot suitable for gliding sports which provides an improvement in comfort, adaptability, foot stability and performance.

A construction in accordance with another aspect of the present invention comprises an upper for a boot having a medial quarter and a lateral quarter and defining a first pair of parallel fastening rows along the front edges of each quarters, at least in the vamp area of the boot, and the median axis of the rows extends between the third and fourth metatarsal bones of the foot.

More specifically the front edges of the lateral and medial quarters include a second pair of fastening rows above the first pair that are offset from the first pair and aligned with the anterior portion of the ankle.

BRIEF DESCRIPTION OF THE DRAWINGS

FIG. 9 is a rear elevation thereof;

DESCRIPTION OF THE PREFERRED EMBODIMENTS

Figure 1:
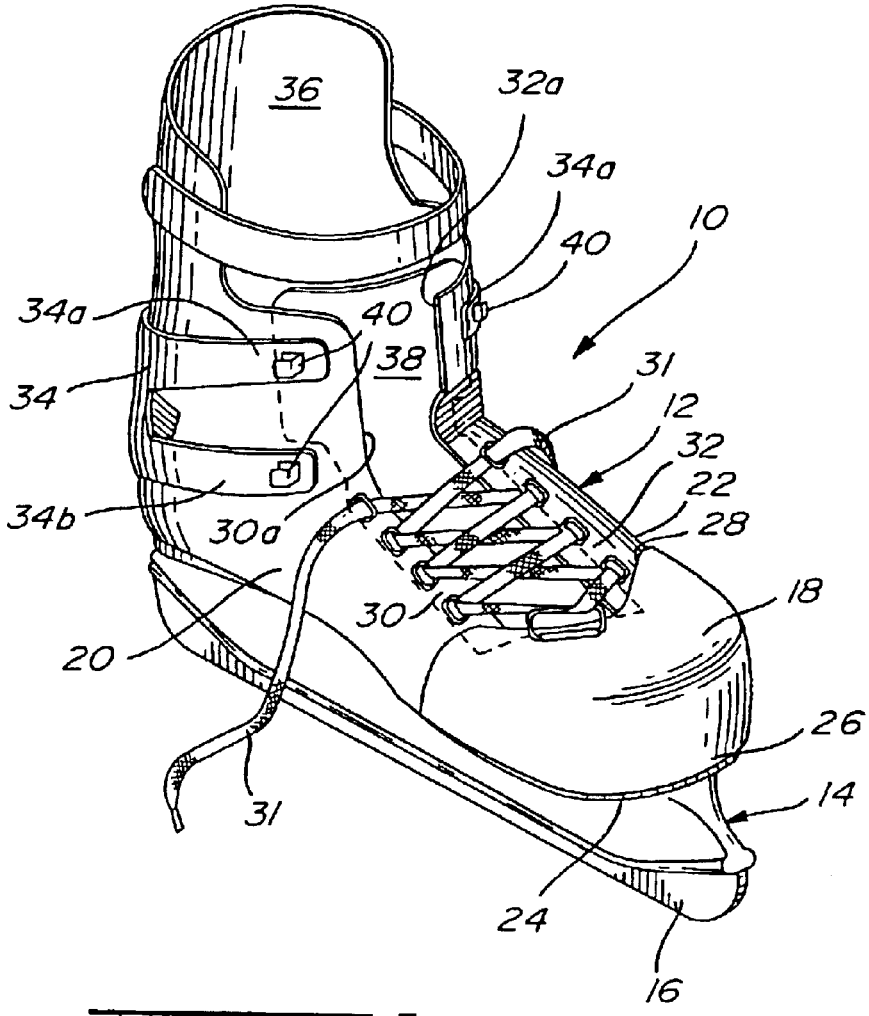
FIG. 1 is a perspective view of a boot in accordance with the present invention.

Referring now to FIGS. 1 to 5 there is shown a skate 10 including a boot 12, a blade support 14, and blade 16. The blade support 14 and the blade 16 are of conventional construction. It is also understood that the boot 12 can be utilized with an inline roller skate support with similar advantages.

It is also contemplated that the boot 12 can be adapted for use with other so called gliding sports such as cross country skiing, specially when using equipment for the skating technique. The boot 12 could also be adapted for other gliding sports such as snow-boarding, skiing, etc.

The boot 12 includes an upper formed with a rigid toe box 18, a lateral quarter 20 and a medial quarter 22. A sole 24 is also provided to which the blade support is fixed.

The toe box 18 includes a lower edge 26 coincident with the edge of the sole 24, the toe box 18 extends rearwardly on the medial side and on the dorsal portion to cover the first metatarsal shaft and must extend laterally rearwardly to cover the fifth metatarsal bone.

The rear edge 28 of the box 18 defines a somewhat parabolic curve in the area of the vamp to coincide with the joints of the second, third, and fourth metatarsal heads. The toe box 18 should be one-piece molded, rigid plastic material with means provided for fastening the tongue 38 as will be described.

The upper includes a lateral quarter 20 and a medial quarter 22 which may be two asymmetric independent pieces joined together in the area of the Achilles tendon or may be a one piece molded plastic shell.

The lateral quarter 20 includes an eyelet row 30 which is aligned with the fourth metatarsal bone. The lateral quarter is fixed along its edge to the sole 24 and forwardly along the rear edge 28 of the toe box 18. The upper portion of the forward edge 30*a* of the lateral quarter 20 is offset from the alignment of the eyelet row 30 in order that it would be symmetrical with the anterior portion of the ankle.

Figures 2, 3, 4, 5:
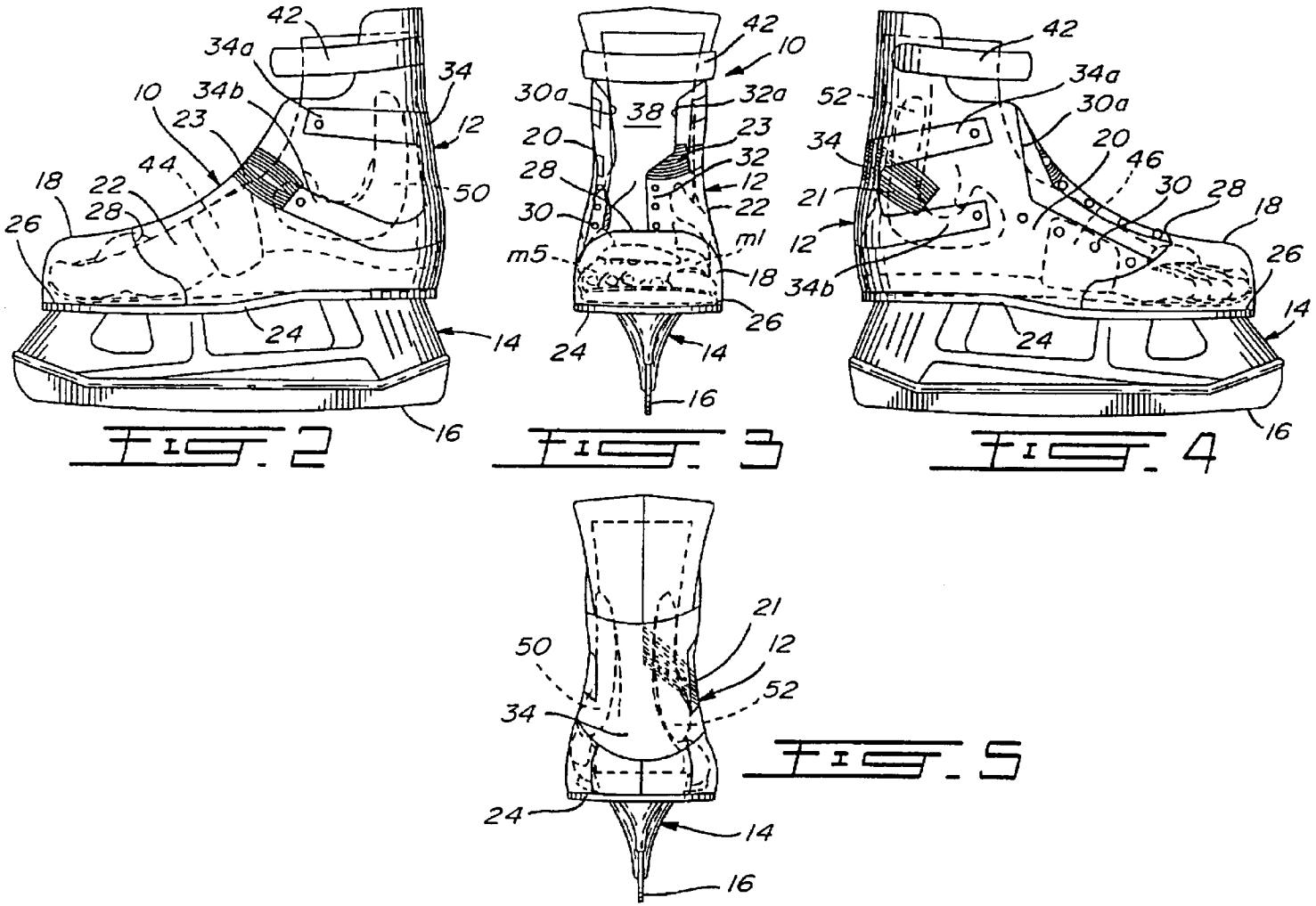
FIG. 2 is a side elevation taken from the medial side of the boot.
FIG. 3 is a front elevation thereof.
FIG. 4 is a side elevation taken from the lateral side of the boot.
FIG. 5 is a rear elevation thereof.

The medial quarter 22 as shown in FIGS. 1, 2, and 3 includes an eyelet row 32 which is aligned with the second metatarsal bone. The gap between the eyelet rows 30 and 32 is offset with respect to the longitudinal axis of the boot as best seen in FIG. 3. The medial quarter 22 is joined at its lower edge to the sole 24 and at its forward edge to the rear edge 28 of the toe box 18. The upper edge 32*a* of the medial quarter 22 is offset from the alignment of the eyelet row 32 and along with the upper forward edge 30*a* of quarter 20 to form a gap which is in alignment with the anterior portion of the ankle, that is with the longitudinal axis of the boot. Thus, in appearance the lacing gap appears to be scewered when seen from the front view as shown in FIGS. 1 and 3.

A lacing band 34 having forwardly extending pairs of fingers 34*a* and 34*b* is loosely mounted to the rear of the boot with the fingers extending forwardly and presenting lacing hooks 40. The lacing band 34 is fixed at least at one point to the rear portion of the upper, at least in the area of the Achilles tendon. The fingers 34*a* and 34*b* on either side of the boot 12 are not directly connected to their respective quarters 20 and 22. Thus, when it is necessary to mount the boot the lacing 31 is first passed through the pairs of eyelets 30 and 32 and then crossed over the hook 40 of fingers 34*a* and 34*b* on either side of the boot. This lacing pattern was designed to maximize the blocking of the foot by use of pads 44, 46, 48, 50 and 52 as will be described.

The tongue 38 is attached in the vamp portion to the toe box 18 at its rear edge 28. The tongue 38 extends from the lateral portion of the first metatarsal shaft to the medial portion of the fifth metatarsal bone. The tongue 38 is fixed along its lateral edge to the lateral quarter 20 in order to best anchor the tongue 38 and prevent it from floating. The tongue 38 includes a contour that follows the gap between the lower eyelet rows 30 and 32 and the gap formed between the upper edges 30*a* and 32*a* to extend over the curved gap portion between them to just pass over the malleolus.

Although not shown on the top edge of the tongue 38 may be folded outwardly to receive the bottom edge of a shin pad. Tongue 38 is lighter than a conventional boot tongue, thereby contributing to the reduction weight of the boot. The tongue is also designed to provide a better anatomical fit.

It is necessary to provide a boot having a rigid boot thereby providing a rigid lever in order to obtain the maximum propulsion force in the power stroke. However, conventional rigid boots are uncomfortable and do not allow certain important movements necessary for skating.

It is known that the axis of the subtalar joint permits complex eversion/inversion and adduction and abduction. The axis of the subtalar joint completes the function of the ankle when pressure is applied as well as when pressure is released. However, under pressure, the extension of the ankle draws the head of the astragalus in adduction causing the pronation of the axis of the subtalar joint. Since skating is partially non-weight bearing, it is thus possible to block the pronation about the subtalar joint axis without limiting the amplitude of necessary ankle movement. This is in order to obtain a rigid lever without restraining the mobility of the ankle.

At the beginning of a power stroke the ankle has an extension movement of between 10° and 25°. However, this extension provokes the adduction of the head of the astragalus causing a pronation movement which is proportional to the loss of power energy. By blocking the subtalar joint the skate acts more like a rigid lever. However, when one changes speed, the ankle must be mobile. Thus, by stabilizing and fixing the foot within the boot while allowing the movement of the ankle, the general skating efficiency can be improved.

Since the skating stroke is partially non-weight-bearing, as compared to walking or running, the movements of the foot can be limited by blocking the foot within the skate so as to provide the rigid lever.

The axis of the ankle is of the pronation/supination type to provide mainly flexion and extension of the foot. During skating, the ankle must be allowed to move between 10° and 25° either in flexion or in extension but no greater. More specifically, the ankle pivots at an angle to the longitudinal axis of the boot and the plane of this flexion/extension is referred to as a dorsal medial flexion in the gliding portion of the stroke while the ankle must flex 10° to 25° in the post lateral direction in the same plane during the power phase of the stroke. Thus, the medial quarter 22 includes a cutout portion with a compressible insert 23 provided therein. The compressible insert 23 may be of a somewhat oval outline and made of a corrugated plastic material with the ribs of the corrugated plastic member 23 extending in the same direction as the pleats formed in the skin during flexion otherwise known as the "resting skin tension lines". The insert 23 could be made of other compressible flexible materials including compressible metals having memory, an air bladder or other spring-like materials. The insert 23 can be sewn or otherwise adhered along its edges to the cutout edge in the medial quarter 22. The center of the insert can be located at a point considered a medial dorsal to the junction of the cartilage to the head of the astragalus. It is also contemplated that the cut outs in the medial and lateral quarters respectively are sufficient to allow for ankle mobility. The compressible inserts 21, 23 are therefore optional and may be used as an energy return mechanism.

A similar lateral compressible insert 21 is provided in the lateral quarter and the center of this insert is fixed to the apex of the peroneus and the Achilles tendon. This insert 21 permits planter flexion during the power stroke.

The compressible inserts 21 and 23 act in the two directions, that is in compression and extension. When the insert is compressed, greater mobility results. When compression pressure on the insert is released the extension of the insert acts as a spring providing synergy to the flexion of the ankle by way of the kinetic thrust which it provides. The compressible inserts are mainly designed to allow specific sagittal plane mobility of the ankle in gliding sports.

Figure 8:
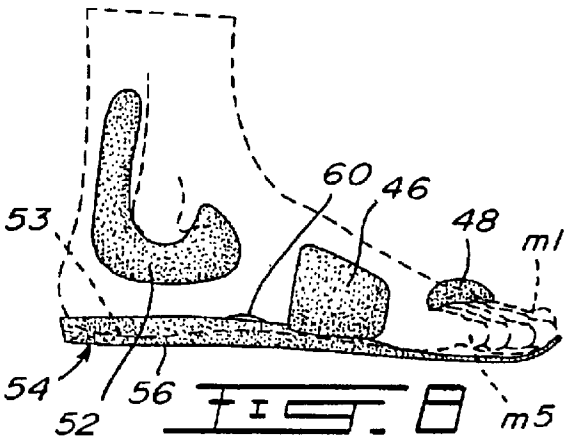
FIG. 8 is a side elevation taken from the lateral side of the spatial arrangement shown in FIGS. 6 and 7.
Figure 7:
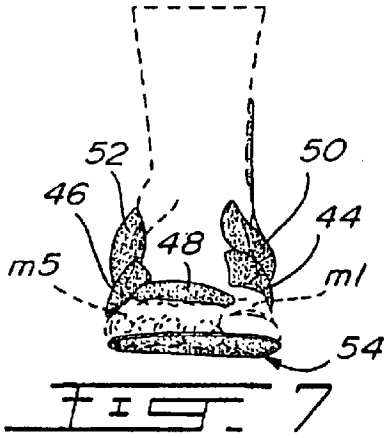
FIG. 7 is a front elevation of the spatial arrangement shown in FIG. 6.
Figure 6:
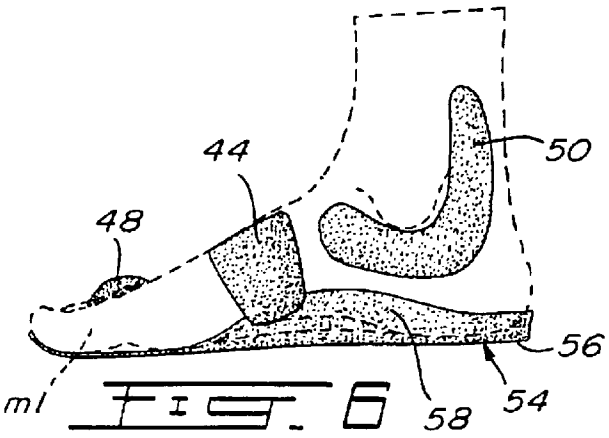
FIG. 6 is a side elevation taken from the medial side showing the spatial arrangement of the pads and foot bed of the present invention.
Figure 5:
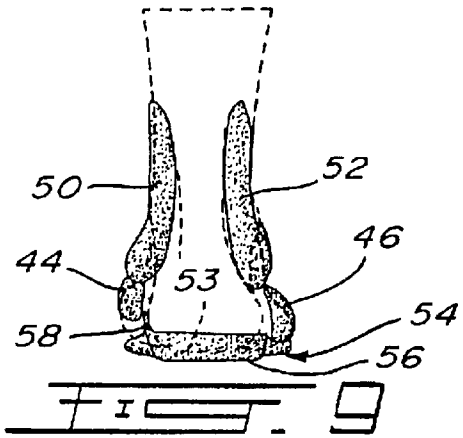
Figure 10A:
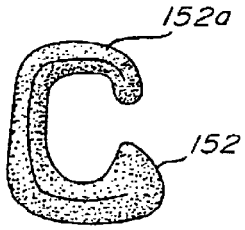
FIG. 10*a* is a front elevation view of another embodiment of the lateral malleolar pad.
Figure 10B:
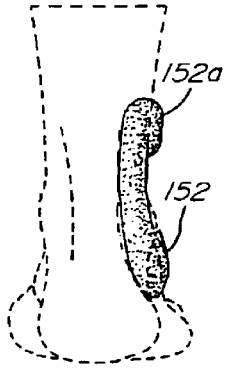
FIGS. 10*b*, 10*c*, and 10*d* represent rear, front, and side views of the malleolar pad shown in FIG. 10*a* in position on the foot shown in dotted lines.
Figure 10C:
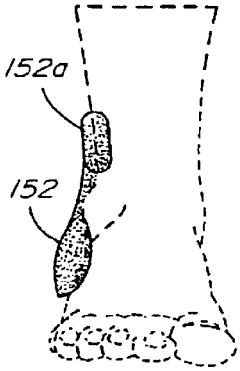
Figure 10D:
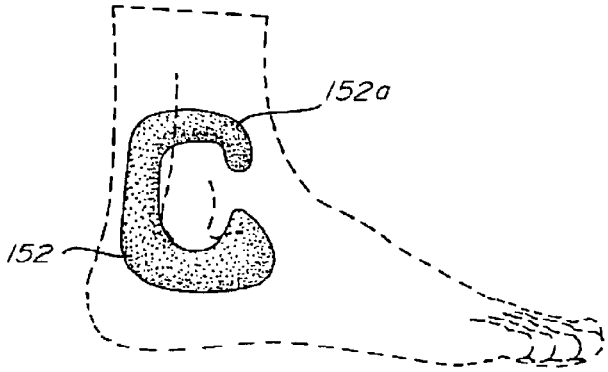
Figure 11A:
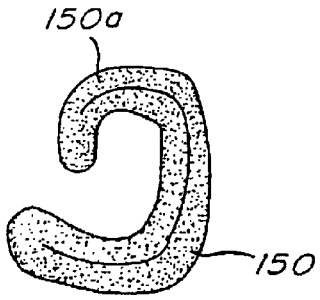
FIG. 11*a* is a front elevation of a medial malleolar pad of the same embodiment as that shown in FIG. 10*a*.
Figure 11B:
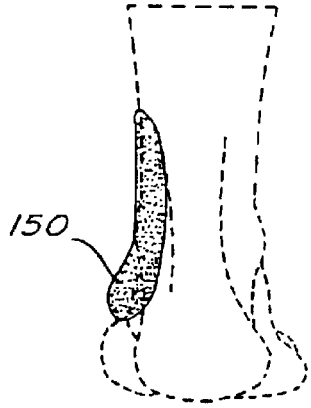
FIGS. 11*b* through 11*d* represent rear, front, and side views of the medial malleolar pad in position on a foot shown in dotted lines.
Figure 11C:
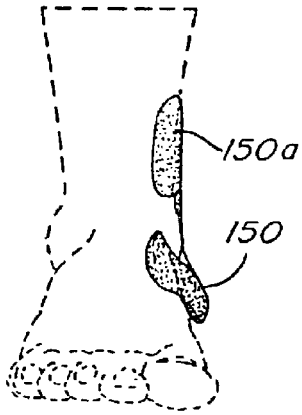
Figure 11D:
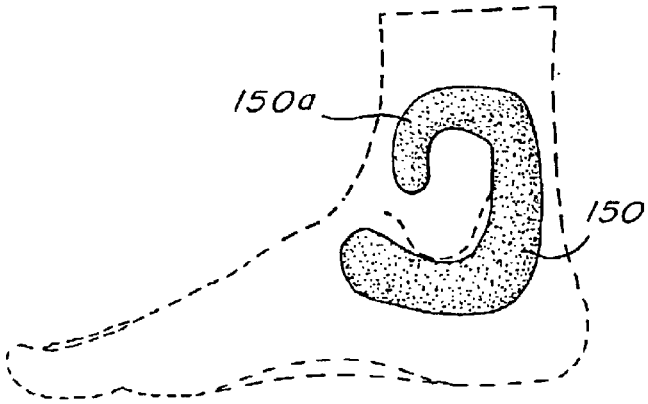

A plurality of distinct pads are strategically located on the inner surface of the upper of the boot 12. These pads can be glued to the inner shell and covered by a liner such as a leather liner similar to a conventional construction of the boot. Although the location of these pads are shown in dotted lines in FIGS. 2 through 5, they are shown in FIGS. 6 to 9 in their relative position to the foot. Medial pad 44 and lateral pad 46 are provided in asymmetric relation on either side of the foot. Even though pads 44, 46 are identical, they are located in asymmetrical relation as shown in FIGS. 6 and 8 for instance. The medial metatarsal pad 44 has a somewhat quadrilateral shape and is located coincident with the base and the head of the first metatarsal shaft. The pad must be convex in the area of contact with the foot in the horizontal axis and must also be convex in its vertical axis, thus it must have somewhat of a dome shape. The lateral metatarsal pad 46 is located in a position coincident with the location between the tubercle and the head of the fifth metatarsus in a horizontal axis. The pad 46 must be convex both in the vertical and horizontal axes. When the boot is laced the medial metatarsal pad 44 and the lateral metatarsal pad 46 protect the first metatarsal bone and the fifth and fourth metatarsal bones, respectively. When the boot is laced the pads 44, 46 will provide a stabilizing force to prevent movement of the foot relative to the boot.

The lacing and metatarsal pads add a plantar flexorial force on the medial and lateral columns of the foot. Thus, the pads 44 and 46 increase the rigid lever effect and provide mechanical advantages to the longitudinal flexors.

The vamp pad 48 is located in the vamp area of the boot which covers the proximal portions of the second to the fifth phalanges in the dorsal area of the metatarsal-phalangeal joints. This pad 48 is generally crescent-shaped. The pad 48 acts to prevent movement of the foot forwardly in the boot. This pad is fixed to the tongue at its junction with the toe box.

The lateral malleolar pad 52 extends between the Achilles tendon and the ankle in the vertical axis filling up the concave area therein and extends downwardly to the post-lateral upper tubercle of the calcaneum by forming a hook. The horizontal component of the malleolar pad 52 extends forward to end just above the cuboid.

The medial malleolar pad 50 extends between the Achilles tendon and the ankle. The malleolar pad 50 has an overall J-shape with a horizontal component extending forwardly into proximity with the tubercle of the scaphoid. Pads 50 and 52 block the foot within the shell of the boot and will prevent the adduction of the head of the astragalus and will support the sustentaculum tali, limiting the pronation about the subtalar joint axis. These two pads 50 and 52 are asymmetric and follow the anatomical form of the foot. Pads 50 and 52 further fill the concave area on either side of the foot behind the ankle and form a wedge to block the foot on the inside of the boot. Thus, it can be seen that these pads will prevent relative movement of the foot in the boot, thereby contributing to the reduction on energy loss. Each pad 50, 52 is compatible with the right or left foot.

In fact, foot movement is transmitted directly to the boot while the cut out portions including compressible inserts 21 and 23 will provide mobility to the boot in response to the foot movements. The cut out portions in the medial and lateral quarters respectively are sufficient to allow proper ankle mobility. The compressible inserts 21, 23 are therefore optional and may be used as an energy return mechanism.

Although not shown, a further pad can be provided in the end of the toe box 18 to eliminate the necessity of manufacturing half sizes or to compensate for the growing foot of a child.

The pads 44, 46, 48, 50 and 52 form an arrangement of strategically located pads within the upper that provide protection and comfort to the foot. It also blocks or stabilizes the foot along with the foot bed, to permit a rigid lever effect which permits suitable ankle mobility. Furthermore it is contemplated that a thinner rigid liner may be used as a result, thereby contributing to reducing the weight of the boot.

An inner sole or foot bed 54 is provided. First of all, a deep, narrow recess 53 is shown in dotted lines and located in their calcaneum bed portion 56. Recess 53 may be 8 mm to 9 mm deep. The surface of the calcaneum slopes at 5° to the frontal plane, thus opposing the pronation force about the subtalar joint axis and providing mechanical advantage to the power muscles In view of this mechanical advantage during the gliding stroke, the axis need not have a large amplitude of movement. In fact the movement of this axis must be restricted. By positioning the calcaneum at a slope of 5° the subtalar joint can be maintained in a position of supination. The muscle leverage is thus increased and the amplitude of movement of the forefoot is decreased, thereby stabilizing the forefoot portion and increasing the force of the power stroke. By relocating the calcaneum at a 5° angle, the functional axes of the foot are reoriented, thereby optimizing the stability of the foot. The deep recess 53 provides sidewalls which limit the lateral movement of the calcaneum within the boot and further controls the pronation force around the axis of the subtalar joint.

The arch 58 of the foot bed 54 is in the form of a parabola extending from the planter tubercle medial of the calcaneum to the head of the first metatarsal bone. The apex of this parabola is located under the medial cuneiform. The height of the apex is determined by the size of the boot (for a 9½ North American men size, the apex is 33 mm high).

The forward portion of the innersole has a 7° slope in the frontal plane but excluding the first metatarsal bone. This provides the most efficient leverage for the power stroke in the skating cycle. The foot bed 54 includes a forward portion which extends below the heads of the fourth and fifth metatarsal bones including the toe. The foot bed extension has a thickness of about 3 mm. A cuboid bump 60 of semi-cylindrical shape has an apex of about 4 mm and is located as shown in FIG. 8.

The material used for the foot bed 54 must be flexible, light and resilient. A multifoam material is used for the top surface layer of the footbed 54 as well as the portion that extends under the toes. The main portion of the footbed 54 is preferably make of "Aliplast" material.

Referring now to FIGS. 10*a* through 10*d* and FIGS. 11*a* through 11*d* there is shown another embodiment of the malleolar pads 150 and 152 which can be compared to the malleolar pads of the embodiments shown in FIGS. 2 through 9. The malleolar pads 150 and 152 have an extension 150*a* and 152*a* which projects forwardly and downwardly to form a C-shape pad surrounding the respective medial and lateral malleolars as shown in FIGS. 10*a* through 10*b* and FIGS. 11*a* through 11*d*. The malleolar pads 150 and 152 of this embodiment apply especially to boots which are used in gliding sports such as downhill skiing, telemark skiing, cross country skiing and snowboarding. The upper extension 150*a* and 152*a* of these pads opposes the heel lift effect experienced in such boots. Most such gliding sports require substantial foot lifting movements to require lifting of substantial weights such as the boot harness and ski. There is a tendency therefore of the heel to move upwardly within the boot. The C-shaped malleolar pads 150 and 152 of this embodiment will have the effect of blocking the foot and stabilize it within the boot and reduce any heel lifting effect.

We claim:

1. A sports footwear having a sole and an upper, the upper having a medial quartet and a lateral quarter arid defining a first pair of parallel fastening rows around a front edge of each quarter, at least in the vamp area of the footwear, and the median axis of the rows extends between the third and the fourth metatarsal bones of the foot, the front edges of the lateral and medial quarters include a second pair of fastening rows above the first pair, wherein the second pair of fastening rows are offset from the first pair and aligned with the anterior portion of the ankle.

2. A sports footwear as defined in claim 1, wherein the fastening rows are provided with a series of lacing eyelets.

3. A sports footwear as defined in claim 1, wherein a lacing band extends about the rear of the boot and includes forward projecting lacing fingers overlapping the medial and lateral quarters respectively extending towards the anterior portion of the ankle, and the second pair of fastening rows comprises lacing books included on the lacing fingers to receive and accommodate a boot lace.

4. A sports footwear as defined in claim 1, wherein a tongue is provided which is attached to a vamp portion of the upper and the tongue includes a contour which follows a gap defined between the first pair of fastening rows and around to the offset second pair of fastening rows.

5. A sports footwear as defined in claim 4, wherein the tongue is fastened along its lateral edge to the lateral quarter and extends between the lateral portion of the first metatarsal bone to the medial portion of the fifth metatarsal bone.

6. A sports footwear as defined in claim 3, wherein the lacing band is fixed to a portion of the upper coincident with the area of the Achilles tendon and a pair of fingers extend forwardly of the band, overlapping over the medial quarter and lateral quarter respectively.

7. In a sports footwear having a sole, an upper, including a medial quarter and a lateral quarter, a plurality of pads on the interior of the upper, wherein the pads include at least a medial metatarsal pad between the base and the head of the first metatarsal bone, a lateral metatarsal pad near the head of the joints between the metatarsus and the phalanges, a medial malleolal pad having a vertical component between the Achilles tendon and the ankle and a horizontal component below the ankle, a lateral malleolal pad having a vertical component between the Achilles tendon and the ankle, and a horizontal component just below the ankle for the purpose of blocking the foot within the boot, and defining a first pair of parallel fastening rows around the front edge of each quarter, at least in the vamp area of the footwear, arid the median axis of tiac rows extends between the third and the fourth metatarsal bones of the foot.

8. A sports footwear as defined in claim 1 the improvement comprising a rigid toe box having a lower edge coincident with a toe portion of the sole, and a rear edge of the toe box being asymmetric and having a parabolic outline between a portion coincident with the joint of the first metatarsal bone and the respective phalange of the foot, and another portion coincident with the joint of the fifth metatarsal bone and the respective phalange.

* * * * *